US005326493A

United States Patent [19]

Takahata et al.

[11] Patent Number: 5,326,493

[45] Date of Patent: Jul. 5, 1994

[54] SOLID DETERGENT COMPOSITION BASED ON N-ACYL SODIUM SALT

[75] Inventors: Masahiro Takahata; Toshio Nozaki, both of Chiba; Koichi Yoshimura, Tochigi, all of Japan

[73] Assignee: Kao Corporation, Tokyo, Japan

[21] Appl. No.: 985,256

[22] Filed: Dec. 3, 1992

[30] Foreign Application Priority Data

Dec. 4, 1991 [JP] Japan ..... 3-320697

[51] Int. Cl.[5] ..... C11D 17/02; C11D 1/10; C11D 3/33

[52] U.S. Cl. ..... 252/117; 252/118; 252/134; 252/546; 252/DIG. 5; 252/DIG. 16

[58] Field of Search ..... 252/546, 527, DIG. 16, 252/DIG. 5, 117, 118, 134

[56] References Cited

U.S. PATENT DOCUMENTS

| | | | |
|---|---|---|---|
| 3,663,459 | 5/1972 | Yoshida et al. | 252/546 |
| 4,273,684 | 6/1981 | Nagashima et al. | 252/544 |
| 5,098,608 | 3/1992 | Miyazawa et al. | 252/546 |

FOREIGN PATENT DOCUMENTS

| | | |
|---|---|---|
| 0460566 | 12/1991 | European Pat. Off. . |
| 53-113806 | 10/1978 | Japan . |
| 1178597 | 7/1989 | Japan . |

*Primary Examiner*—Paul Lieberman
*Assistant Examiner*—A. Hertzog
*Attorney, Agent, or Firm*—Sughrue, Mion, Zinn, Macpeak & Seas

[57] ABSTRACT

A solid detergent composition is disclosed, which comprises the following components (A) and (B):

(A) an N-acyl compound represented by the following formula (1)

$$R^1CONH(CH_2)_2COONa \quad (1)$$

wherein $R^1CO$ represents a straight chain acyl group having 10 to 16 carbon atoms; and (B) one or more compounds selected from higher fatty acids and higher alcohols. This solid detergent composition is low-irritative and excellent in foaming properties and foam texture, gives no squeaky feel during and after rinsing and imparts a smooth feel to skin. It is highly suitable, in particular, for cleansing the skin.

4 Claims, No Drawings

SOLID DETERGENT COMPOSITION BASED ON N-ACYL SODIUM SALT

FIELD OF THE INVENTION

This invention relates to a solid detergent composition. More particularly, it relates to a solid detergent composition which is excellent in foaming properties and foam texture, gives a good feel during and after use and is suitable, in particular, for cleansing the skin.

BACKGROUND OF THE INVENTION

Known low-irritative solid detergent compositions comprise anionic surfactants having near neutral pH values (for example, sodium lauryl sulfate) or weakly acidic surfactants (for example, sodium N-acylglutamate), either alone or together with a soap. There have also been known detergents wherein fatty acid triethanolamine salts are used as a soap base in order to reduce the effects of free alkalis contained in soaps as disclosed, for example, in Fragrance Journal, vol. 47, page 47 (1981) Recently, it has been furthermore reported that a low-irritative solid detergent composition can be obtained by adding an alkyl sulfosuccinate or an ethylene oxide adduct salt thereof to a soap base as disclosed, for example, in JP-A-2-155991 (the term "JP-A" as used herein means an "unexamined published Japanese Patent Application").

However, these low-irritative solid detergents are still unsatisfactory from the viewpoint of irritation, because they have an excessively high detergency or a pH value of 8 to 9. In addition, they have an undesirable feel during washing. Namely, they have a sticky or slimy feel during use or give a stretched or dry/rough feel after drying. When synthetic surfactants are used as a detergent base, on the other hand, the shape of the solid detergent compositions is easily deformed and have poor strength upon molding, compared with common soaps.

Accordingly, an objective of the present invention is to provide a less irritative solid detergent composition which gives a good feel during and after use and has an excellent solidity.

Under these circumstances, the present inventors have conducted extensive investigations. Consequently, the inventors found that a solid detergent composition, which has an appropriate detergency and good foaming properties characteristic of detergent compositions, is less irritative than conventional detergent compositions and gives a good feel during and after use, can be obtained by adding a specific N-acyl compound of a secondary amide type, as a detergent base, to higher fatty acid(s) or higher alcohol(s).

SUMMARY OF THE INVENTION

Accordingly, the present invention provides a solid detergent composition which comprises the following components (A) and (B)

(A) an N-acyl compound represented by the following formula (1):

$$R^1CONH(CH_2)_2COONa \quad (1)$$

wherein $R^1CO$ represents a straight chain acyl group having 10 to 16 carbon atoms; and (B) one or more compounds selected from higher fatty acids and higher alcohols.

DETAILED DESCRIPTION OF THE INVENTION

The N-acyl compound to be used as component (A) in the present invention is a compound represented by the above formula (1). In formula (1), $R^1CO$ is a straight chain acyl group having 10 to 16 carbon atoms, preferably 12 to 14 carbon atoms. It is particularly preferable that $R^1CO$ is a straight chain acyl group having 12 carbon atoms (i.e., lauroyl group or myristoyl group. It is undesirable that the carbon atom number in $R^1CO$ exceeds 16, since the texture of the detergent composition then deteriorates. On the other hand, it is undesirable that the carbon atom number therein is less than 10, since only poor foaming is achieved.

As the higher fatty acids to be used as component (B) of the present invention, ones having 12 to 20 carbon atoms are preferred. Examples thereof include lauric acid, myristic acid, palmitic acid and stearic acid. Alternately, fatty acids obtained by decomposing animal fats and oils (for example, lard, beef tallow) or vegetable fats and oils (for example, coconut oil, palm oil, palm kernel oil, soybean oil) may be used therefor. As the higher alcohols to be used as component (B) of the present invention, on the other hand, ones having 14 to 18 carbon atoms are preferred. Examples thereof include myristyl alcohol, cetyl alcohol, palmityl alcohol, stearyl alcohol and eicosanol. Among these higher fatty acids and higher alcohols, stearic acid, coconut oil fatty acid, myristyl alcohol, palmityl alcohol and stearyl alcohol are more preferred.

Either one of these higher fatty acids and higher alcohols or a mixture thereof may be used in the present invention.

It is preferred that the solid detergent composition according to the present invention contains from 40 to 99% by weight (hereinafter, "% by weight" will be abbreviated as simply "%") of component (A) and from 1 to 60% of component (B). It is further preferred that the solid detergent composition according to the present invention contains from 50 to 95% of component (A) and from 5 to 50% of component (B). When the content of component (A) is less than 40%, the solid detergent composition gives a squeaky feel during and after rinsing, similar to a conventional soap. On the other hand, a solid product can not be obtained without using component (B). The "squeaky feel" here is defined as a less slippery feel due to high friction on the surface of skin washed by a conventional soap.

It is preferred that the solid detergent of the present invention contains components (A) and (B) in a weight ratio of component (A):component (B) of 1:2 to 9:1, preferably 1:1 to 8:1.

In addition to the above-mentioned essential components, the solid detergent composition according to the present invention may contain one or both of magnesium oxide and calcium oxide, in order to prevent softening/swelling, melt-off and the occurrence of cracks in the solid detergent composition.

The magnesium oxide and calcium oxide to be used in the present invention are not specifically limited, and are generally available from the market. The particle size range of the oxides is preferably between 0.1 and 100 μm, more preferably between 0.1 and 50 μm. The blending amount, in total, is generally from 0.02 to 5.0%, and preferably from 0.1 to 2.0%, based on the total detergent composition. An amount less than 0.01% is insufficient in bringing about the beneficial effects and an amount more than 5.0% may cause a problem in the solidity of the composition during manufacture.

The solid detergent composition according to the present invention may further contain, if desired, various components commonly used in skin cleansers, for example, humectants (e.g., propylene glycol, glycerol), oily components (e.g., other fatty acid esters, silicone), surfactants (e.g., amphoteric surfactants such as alkylamine oxides, fatty acid alkanolamides, imidazoline), texture improvers (e.g., silicone derivatives, squalane, lanolin), inorganic and organic salts, diluents, anti-inflammatory agents, viscosity controllers, solubilizing agents, water-soluble polymers, perfumes, pigments, UV absorbers, antioxidants, bacteriocides and preservatives. In particular, the effect of the bacteriocide can last for a long period of time in the solid detergent composition of the present invention, and thus it may preferably be employed in the present invention. Preferred examples of the bacteriocide include triclosan, trichlorocarbanilide, isopropylmethylphenol and chlorhexidine hydrochloride.

The solid detergent composition of the present invention may be produced, for example, in accordance with the following method. Namely, an aqueous solution of sodium hydroxide in an amount sufficient for neutralizing an unneutralized N-acyl compound (1) is heated in a kneader and then homogeneously mixed with the N-acyl compound (1). Next, higher fatty acid(s) and/or higher alcohol(s) are added thereto and the resulting mixture is further stirred until a homogenous mixture is obtained. Then the mixture is removed from the kneader and cooled to room temperature using, for example, a chilling roll. After adding, for example, perfumes and pigments, the mixture is kneaded with a soap prodder and extruded via a conical die. Then it is molded with a bar soap stamping machine and thus the solid detergent composition of the present invention is obtained.

The solid detergent composition of the present invention is low-irritative and has excellent foaming properties and foam texture, gives no squeaky feel during and after rinsing and imparts a smooth feel. Thus it is suitable, in particular, for cleansing the skin.

The solid detergent composition of the present invention, which is low-irritative, is particularly suitable for those having sensitive skin. Further, it gives no squeaky feel, which makes it suitable for using in areas that have hard water.

To further illustrate the present invention in greater detail, and not by way of limitation, the following Examples will be given.

EXAMPLE AND COMPARATIVE EXAMPLE

Solid detergent compositions having the compositions specified in Table 1 were produced. The feel upon use and the solidity of each product were evaluated. Table 1 summarizes the results.

Production Method

Lauroyl-β-alanine (acid type) was heated to 60° C. in a 5 l-volume kneader. Then it was neutralized by adding a 25% aqueous solution of sodium hydroxide with stirring. Next, lauric acid and stearic acid were added thereto and the mixture was further stirred. Then it was removed from the kneader and cooled to room temperature using a chilling roll. After adjusting the water content to 10%, the mixture was kneaded in a soap plodder twice and extruded via a conical die. Then it was molded by forging to thereby give a solid detergent of the present invention (Product of the Invention 1). Other solid detergent compositions were produced in the same manner.

Evaluation Method

Ten panelists washed their hands with each solid detergent composition using tap water (hardness: 4° DH) and evaluated the lack of squeaky feel and the presence of refreshing feel based on the following criteria. Further, the solidity was similarly evaluated at the molding stage with the use of a bar soap stamping machine.

A: Very good
B: Good
C: Somewhat poor
D: Poor

As Table 1 clearly shows, the solid detergent compositions of the present invention were superior to the comparative ones in solidity. Namely, the shape of the present solid detergent compositions was scarcely deformed. Further, the solid detergent compositions of the present invention gave no squeaky feel during cleansing and imparted a smooth and good feel after rinsing.

When each of Products of the Invention 1 to 4 were used by 2 panelists (8 panelists in total) for cleansing the body for one week, no irritation such as skin chapping was observed.

Products of the Invention 1 to 4 and Comparative Products 1 and 2 were molded into a rectangular parallelepiped (1 cm×1 cm×5 cm) and immersed in tap water for 4 hours. Then the degree of deformation was evaluated based on the following criteria. As a result, the products of the present invention, in particular, Products of the Invention 3 and 4, were scarcely deformed.

A: Very good
B: Good
C: Somewhat poor
D: Poor

TABLE 1

| | Products of the Invention | | | | Comparative Products | |
|---|---|---|---|---|---|---|
| | 1 | 2 | 3 | 4 | 1 | 2 |
| Sodium lauroyl-β-alanine | 70 | — | 70 | — | 90 | — |
| Sodium myristoyl-β-alanine | — | 70 | — | 70 | — | 90 |
| Lauric acid | 5 | 5 | — | 10 | — | — |
| Stearic acid | 15 | 15 | — | — | — | — |
| Coconut oil fatty acid | — | — | — | 6 | — | — |
| Myristyl alcohol | — | — | — | — | — | — |
| Palmityl alcohol | — | — | 2 | 2 | — | — |
| Stearyl alcohol | — | — | 2 | 2 | — | — |
| Water | 10 | 10 | 10 | 10 | 10 | 10 |
| Solidity | A | A | A | A | D | D |
| Deformation | B | B | A | A | D | D |

EXAMPLE 2

A solid detergent composition having the following composition according to the present invention was produced and the feel at use, the solidity and the deforming property were evaluated. As a result, the product showed good results in all of the evaluation items.

| Composition: | |
|---|---|
| Component | Amount (% by weight) |
| Sodium lauroyl-β-alanine | 70.0 |
| Lauric acid | 10.0 |
| Coconut oil fatty acid | 5.0 |
| Palmityl alcohol | 1.5 |
| Stearyl alcohol | 1.5 |
| Dibutylhydroxytoluene | 0.05 |
| Perfume | 1.15 |
| Pigment | 0.30 |
| Water | balance |

EXAMPLE 3

A solid detergent composition of the following composition was produced and the feel at use, the solidity and the deforming property were evaluated. As a result, the product showed good results in all of the evaluation items.

| Composition: | |
|---|---|
| Component | Amount (% by weight) |
| Sodium lauroyl-β-alanine | 60.0 |
| Lauric acid | 10.0 |
| Stearic acid | 12.0 |
| Palmityl alcohol | 3.0 |
| Stearyl alcohol | 3.0 |
| Dibutylhydroxytoluene | 0.05 |
| Perfume | 1.15 |
| Pigment | 0.30 |
| Water | balance |

While the invention has been described in detail and with reference to specific examples thereof, it will be apparent to one skilled in the art that various changes and modifications can be made therein without departing from the spirit and scope thereof.

What is claimed is:

1. A solid detergent composition which comprises the following components (A) and (B):

(A) an N-acyl compound represented by the following formula (1):

$$R^1CONH(CH_2)_2COONa \quad (1)$$

wherein $R^1CO$ represents a straight chain acyl group having 10 to 16 carbon atoms; and (B) one or more compounds selected from the group consisting of a higher fatty acid and a mixture of a higher fatty acid and a higher alcohol, wherein said component (A) is present in an amount of from 50 to 95% by weight and said component (B) is present in an amount of from 5 to 50% by weight.

2. A solid detergent of claim 1, wherein said $R^1CO$ represents lauroyl group or myristoyl group.

3. A solid detergent of claim 1, wherein said higher fatty acid is selected from the group consisting of lauric acid, myristic acid, palmitic acid, stearic acid, fatty acids obtained by decomposing animal fats and oils selected from lard and beef tallow, and fatty acids obtained by decomposing vegetable fats and oils selected from coconut oil, palm oil, palm kernel oil and soybean oil.

4. A solid detergent of claim 1, wherein said higher alcohol is selected from the group consisting of myristyl alcohol, cetyl alcohol, palmityl alcohol, stearyl alcohol and eicosanol.

* * * * *